United States Patent [19]

Roch

[11] 4,004,510

[45] Jan. 25, 1977

[54] EQUIPMENT FOR INTRODUCTION OF A STRIP OF PAPER, CARDBOARD OR SIMILAR MATERIAL INTO A PRINTING MACHINE

[75] Inventor: Roger Roch, Lausanne, Switzerland

[73] Assignee: J. Bobst & Fils S.A., Prilly, Switzerland

[22] Filed: Nov. 11, 1974

[21] Appl. No.: 522,706

[30] Foreign Application Priority Data

Nov. 13, 1973 Switzerland ..... 15914/73

[52] U.S. Cl. ..... 101/228; 73/95.5; 101/232; 226/25; 318/6

[51] Int. Cl.² ..... B41F 13/54

[58] Field of Search ..... 101/178, 181, 228, 231, 101/232, 248, DIG. 21; 197/160; 226/25, 42, 44; 318/6; 73/95.5

[56] References Cited

UNITED STATES PATENTS

| | | | |
|---|---|---|---|
| 3,087,663 | 4/1963 | Anderson | 101/228 |
| 3,183,711 | 5/1965 | Duncan | 73/95.5 X |
| 3,229,175 | 1/1966 | Strandberg | 318/6 |
| 3,324,363 | 6/1967 | Hill et al. | 318/6 |
| 3,329,087 | 7/1967 | Sandor et al. | 101/181 |
| 3,348,107 | 10/1967 | Hamby | 318/6 |
| 3,474,311 | 10/1969 | Lewis, Jr. | 318/6 |
| 3,506,863 | 4/1970 | Fallis | 318/6 |
| 3,590,632 | 7/1971 | Gegenschatz | 73/95.5 |
| 3,633,504 | 1/1972 | Chambon | 101/228 |
| 3,725,755 | 4/1973 | Stabile | 318/6 |
| 3,749,329 | 7/1973 | Nedreski | 242/75.51 |
| 3,749,331 | 7/1973 | Nedreski | 242/75.51 |

FOREIGN PATENTS OR APPLICATIONS

| | | | |
|---|---|---|---|
| 271,355 | 12/1964 | Australia | 73/95.5 |

*Primary Examiner*—Richard C. Pinkham
*Assistant Examiner*—Vance Y. Hum
*Attorney, Agent, or Firm*—Hill, Gross, Simpson, Van Santen, Steadman, Chiara & Simpson

[57] ABSTRACT

In a printing machine, a device for introducing a continuous web of paper to the printing station, the device having apparatus to continually measure the coefficient of elasticity of the web and apparatus for developing a tension on the web as a function of the measured coefficient of elasticity. The web is fed against two tension measuring devices in conjunction with two traction rollers having slightly different radii from which the coefficient of elasticity can be calculated electronically.

7 Claims, 5 Drawing Figures

27 PID CALCULATOR
AMP
7 EXCITATOR
M
33 MOTOR
COUNTER-WEIGHT
35 RESISTOR
AMP
Tmin
POTENTIOMETER
POTENTIOMETER
POTENTIOMETER
37 MULTIPLIER CIRCUIT
19 CIRCUIT
AMP
AMP
$e^{-SL}$
$1-e^{-\frac{x}{L}}$
$\frac{R_2-R_1}{R_1}$
$\frac{R_1}{R_2-R_1}$

EQUIPMENT FOR INTRODUCTION OF A STRIP OF PAPER, CARDBOARD OR SIMILAR MATERIAL INTO A PRINTING MACHINE

FIELD OF THE INVENTION

Field of art to which this invention pertains is electronic devices for measuring and controlling tension and elasticity in a feeding arrangement for supplying a web to a printing machine.

SUMMARY OF THE INVENTION

It is a principal feature of the invention to provide an improved means for feeding a web of material to a printing apparatus.

It is also a feature of the present invention to provide a means for regulating tension on a web being fed to a printing device.

It is a principal object of the present invention to provide a means for controlling the tension of a web being fed to a printing apparatus as a function of the coefficient of elasticity of the web as measured continually by a calculator.

It is also an object of the present invention to provide a device for measuring the coefficient of elasticity of a web in an apparatus as described above as a function of a first parameter representing an elongation value and a second parameter representing the tension on the web under the conditions of which the elongation value is measured.

It is a further object of the present invention to provide a device for applying tension to the web being fed to a printing apparatus wherein tension is applied as a function of the coefficient of elasticity of the web and which device has a correction means to allow for the non-linearity to allow for the tension-elongation relationship of the material being printed.

It is an additional object of the present invention to provide a calculator to produce a tension signal in response to the measured coefficient of elasticity of a web being fed to a printing apparatus which introduces a delay to allow for the length of strip between the feed equipment and the printing machine itself.

These are another features and advantages of the present invention will be understood in greater detail from the following description and associated drawings when reference numerals are utilized to designate a preferred embodiment.

BRIEF DESCRIPTION OF THE DRAWINGS

The attached drawing shows, by way of example, one embodiment of the invention.

DESCRIPTION OF THE PREFERRED EMBODIMENT

The present invention relates to a means for introducing a strip of paper, cardboard or other similar web-like material into a printing machine in such a manner as to optimize the format control of the machine. This apparatus is electronic in nature and includes calculator means for developing a signal indicative of the coefficient of elasticity of the web and using that signal to produce a tension value to apply a tension to the moving web in response to said coefficient of elasticity.

For the purpose of introduction of a strip of paper into a printing machine, an introduction unit is used, the function of which has hitherto been restricted to isolating more or less effectively the printing units from the perturbations which could originate in the unreeler. Its effect is therefore comparable to the part played by a filter, which suppresses or reduces the propagation of variations in tension from the unreeler towards the printing units. Such an introduction unit does not, however, meet the needs of modern rotary printers. Indeed, since a strip must be treated after printing, either in line with the rotary or on a separate machine, a format control is required which will ensure subsequent treatment under the best possible conditions. As an example can be quoted working on platens, where the format at rest, that is at zero tension, must be constant. On the other hand, when the strip is intended for insetting, that is a strip pre-printed in helic is then introduced into a rotary for reprinting, the strip is subjected to a certain tension during reprinting, in such a manner that it is desirable to ensure a constant format under a determined tension.

The aim of the invention is the realization of an introduction unit which can satisfy the special conditions and can provide selectively either an introduction at constant tension, as is now the case, or an introduction at constant elongation, that is ensuring a constant format at rest, or again a mixed introduction at constant elongation under a predetermined tension with a view to ensuring a constant format under a given tension.

The equipment in accordance with the invention is characterized by the fact that it comprises means for continuous measurement of the coefficient of elasticity of the strip and means for providing and applying to the strip a tension which is a function of the coefficient of elasticity as continuously measured.

It is known that continuous measurement of the coefficient of elasticity of the strip enables this problem to be fairly easily solved. This measurement of the coefficient of elasticity forms the subject of the copending patent application Ser. No. 503,295, now U.S. Pat. No. 3,933,035.

Figure 1:
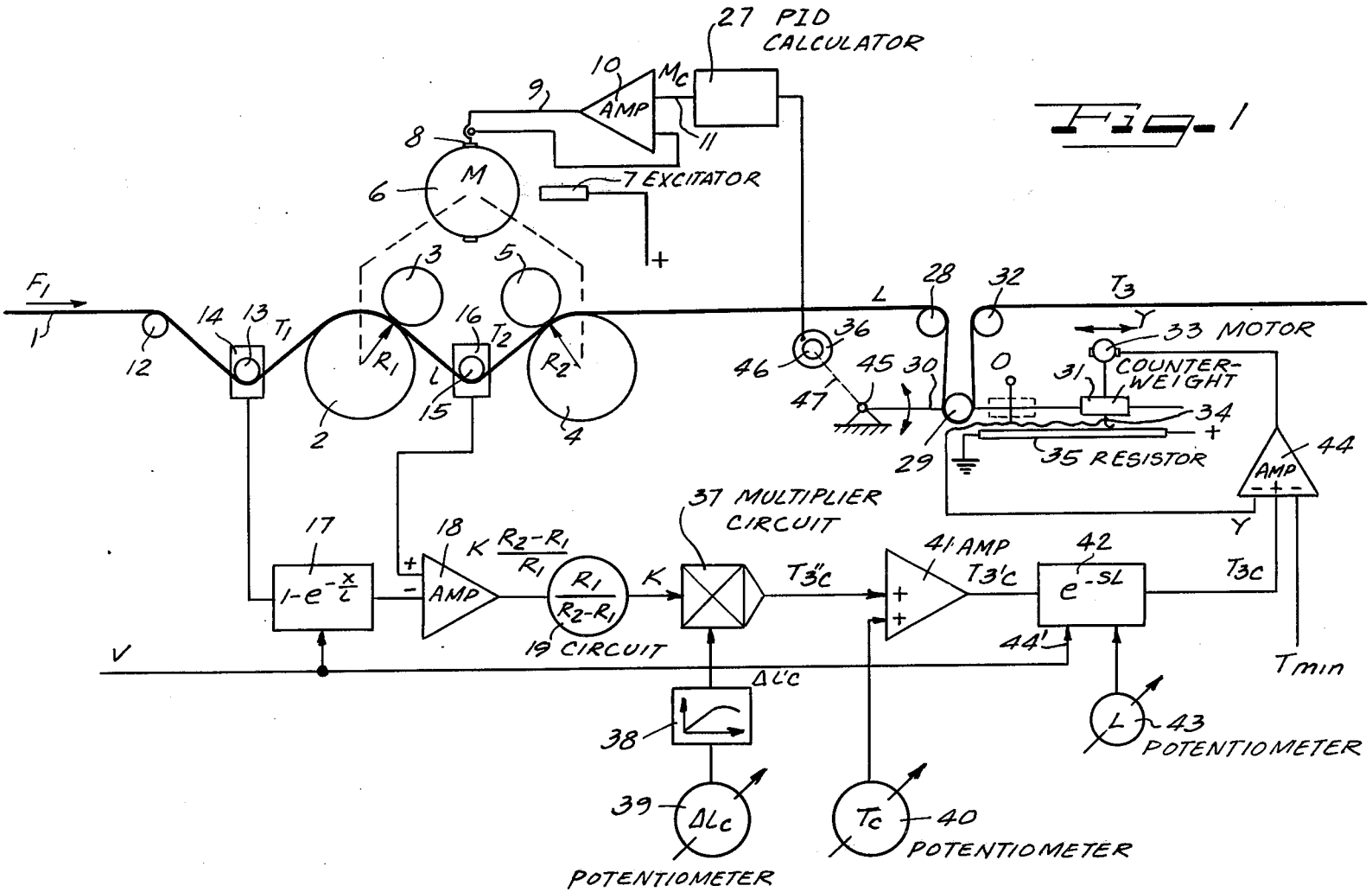
FIG. 1 shows a diagram of the equipment.

FIG. 1 is a diagrammatic representation of a strip of paper 1 coming from a reel and being unreeled in the direction of the arrow $F_1$ so as to be introduced into a printing unit which is not shown. This strip is drawn along by a mechanical arrangement comprising a first traction roller 2 or radius $R_1$ cooperating with a pressure roller 3, and a second traction roller 4 of radius $R_2$ cooperating with a pressure roller 5. The traction rollers 2 and 4 are driven at the same angular velocity by a motor 6. This is a direct current motor with constant excitation 7. Its armature 8 is fed by a static drive comprising a loop 9 controlled by the armature current. The loop is closed through an operational amplifier 10 at the input 11 of which is applied a motor couple of appropriate value provided by a calculator 27.

The strip 1 also passes over a wheel 12 with fixed axis, over a wheel 13 of a first device 14 for measuring the tension in the strip before traction roller 2, and over a third wheel 15 of a second device 16 for measuring tension before the second traction roller 4. The devices 14 and 16 are known in themselves and are in common use for obtaining an electrical value proportional to the mechanical tension exerted on a strip.

The strip then passes over a fixed wheel 28 and then over a sliding wheel 29 mounted on a lever 30 provided with a movable counterweight 31, and over a fixed wheel 32 before entering the printing unit. The slider 29 and its counterweight 31 are for the purpose of impressing on the strip a set tension calculated by means of circuits which will be described later. The counterweight 31 is driven by an electric motor 33 and is solid with the slider 34 of a variable resistor 35. A device 36, solid in displacement with the slider, provides an input value for the calculator 27.

In addition, the equipment includes a device 17 which introduces a time constant according to the function $1 - e^{-x/L}$ to which is applied firstly the electrical value provided by the measuring device 14, and secondly an electrical value proportional to the rate of displacement of the strip, a circuit 18 comprising an operational amplifier to which are applied both the electrical values delivered from the devices 16 and 17 and delivering a signal proportional to the difference of these electrical values, and lastly a divider circuit 19 with an output giving an electrical value proportional to the sought coefficient of elasticity.

Radius $R_2$ is slightly greater than radius $R_1$, by about one part in a thousand. Since the angular velocities of these two traction rollers are strictly identical, this difference in radius leads to an increase in strip speed of 0.1% between the traction rollers 2 and 4, that is to a fixed increase in the specific elongation of the strip of $(R_2-R_1)/R_1$.

Since the coefficient of elasticity K is equal to the ratio "increase in tension/increase in elongation," we obtain in the stationary state:

$$K = \frac{T_2 - T_1}{R_2 - R_1} \cdot R_1$$

where $T_1$ and $T_2$ are the mechanical tensions measured by devices 14 and 16 respectively.

In dynamic conditions, it is necessary to have regard to the fact that a variation in the strip tension $T_1$ does not have an immediate effect on tension $T_2$, but that there is a "time constant" due to the two pairs of traction-pressure rollers.

This time constant is equal to the length $L$ of the strip lying between the two traction rollers, and a perturbation $\Delta T_1$ is transmitted in accordance with the law:

$$\Delta T_2(T_1) = (1 - e^{-x/L}) \cdot \Delta T_1$$

Therefore, so as to make a valid comparison between the two sets of information provided by the tension measurement devices, it is convenient to subject the first measurement to the same attenuation function, by electronic means, as the variations in tension $T_1$ before reaching the level of $T_2$.

On introduction of this correction factor, the coefficient of elasticity in dynamic conditions becomes:

$$K = \frac{T_2 - T_1 (1 - e^{-x/L})}{R_2 - R_1} \cdot R_1$$

On introduction of this time constant we then obtain a continuous and exact measurement of the coefficient of elasticity for whatever variations may take place in tension $T_1$. The difficulty lies in the transition from the length magnitude to the time magnitude. It has, however, been possible to effect this transformation in a relatively simple manner. If $v$ is the strip speed and $x$ is the distance travelled by the strip in time $t$, we have:

$$x = v \cdot t \text{ and}$$

$$1 - e^{-x/L} = 1 - e^{-vt/L} = 1 - e^{-t/\tau}$$

It is now necessary to define by analogy a time constant which is a function of the speed by means of the relationship $$\tau(v) = 1/v$$

Circuit 17 produces exactly the function $1 - e^{-x/L}$ as a function of the speed $v$ of the strip measured by a tachymetric device. Circuit 18 produces an electrical value proportional to:

$$T_2 - T_1 (1 - e^{-x/L})$$

and circuit 19 divides this value by a factor proportional to $$(R_2 - R_1)/R_1.$$

Knowledge of the coefficient of elasticity $k$ makes it possible, by multiplying by a set elongation, to obtain a tension. This is effected by a multiplier circuit 37 to which is fed both the value proportional to $k$ from circuit 19, and a value $\Delta L'c$ from a circuit 38 to which is fed, by means of a potentiometer, a set elongation $\Delta Lc$. Circuit 38 is introduced to allow for the non-linearity of the relationship $T = F(\Delta L)$ for certain materials.

At the output of circuit 37 is obtained a value proportional to a tension $T'_{3c}$ to which can be added a tension $T_c$ determined by a potentiometer 40 and added by means of a circuit 41. At the output of circuit 41 is then obtained a tension value given by the relationship:

$$T'_{3c} = L'c \cdot k = T_c$$

In order to apply this tension to the strip it is necessary to have regard to the lag corresponding to the free length of strip L, between the introduction unit and the first printing out. To allow for this length a pure delay is introduced by means of a circuit 42 which introduces a delay according to the function $e^{-sL}$, where $L$ is adjusted to the necessary value by means of a potentiometer 43.

Since this delay must also be a function of the strip speed, this variable is introduced into circuit 42 at 44'. At the output of circuit 42 we then obtain a tension $T_c$ given by the following relationship:

$$T_{3c} = T'_{3c} e^{-sL}$$

The set tension $T_{3c}$ so obtained is applied to the strip by means of sliding wheel 29 and its counterweight 31 by means of an operational amplifier 44, to the input of which are applied set tension $T_{3c}$, a minimum tension $T_{min}$ corresponding to the minimum tension which can be obtained with the sliding wheel 29, with the counterweight at position *o*, and a value *y* corresponding to the position of the counterweight 31, that is to say of slider 34 on resistor 35. The value $T_{min}$ and *y* are subtracted from $T_{3c}$. The output current from amplifier 44 feeds motor 33 which moves the counterweight 31. Therefore, to a given tension $T_{3c}$ there corresponds a well determined position of the counterweight, given by the relationship:

$$y = g(T_{3c} - T_{min})$$

Use of a sliding wheel for applying tension to the strip presents many advantages. It allows friction to be reduced to a minimum. In place of the bar shown in the drawing, it is possible in particular to use an articulation with crossed blades. The effect of the angular position of the sliding wheel with respect to its axis of articulation 45, on the resultant tension is small. This effect can in addition be limited by increasing the lengths of the parts of the strip which go round the sliding wheel. The tension exerted on the strip being dependent on the length of the lever arm, it is possible to have a high tension in the strip while still retaining a relatively low mass for the sliding wheel-counterweight assembly. Finally, control of strip tension is effected solely by adjustment of the position of the mobile counterweight 31. Adjustment applied in the open loop ensures good stability of the whole introduction.

The position of sliding wheel 29 is measured by detector 36 which produces an electric value which is fed into PID calculator 27. In order to prevent any damping at the level of the sliding wheel, and so as to limit to the minimum variations in strip tension during displacement of the sliding wheel, it is preferable to introduce a differential term with a significance of the order of half the significance of the proportional term given by the wheel position. This differential term is given by a tachymetric generator 46 mounted with a position-indicating potentiometer 36 on the pivot axis 47 of the sliding wheel. Thus the true derivative of the position, that is the rate of angular displacement of the sliding wheel assembly is obtained. It is, of course, equally possible to calculate the differential term by analogue means. The gains of the different terms of the PID calculator 27 are determined by simulation technique starting from important mechanical values such as inertias, masses, exact course of the wheel, etc.

Figure 2:
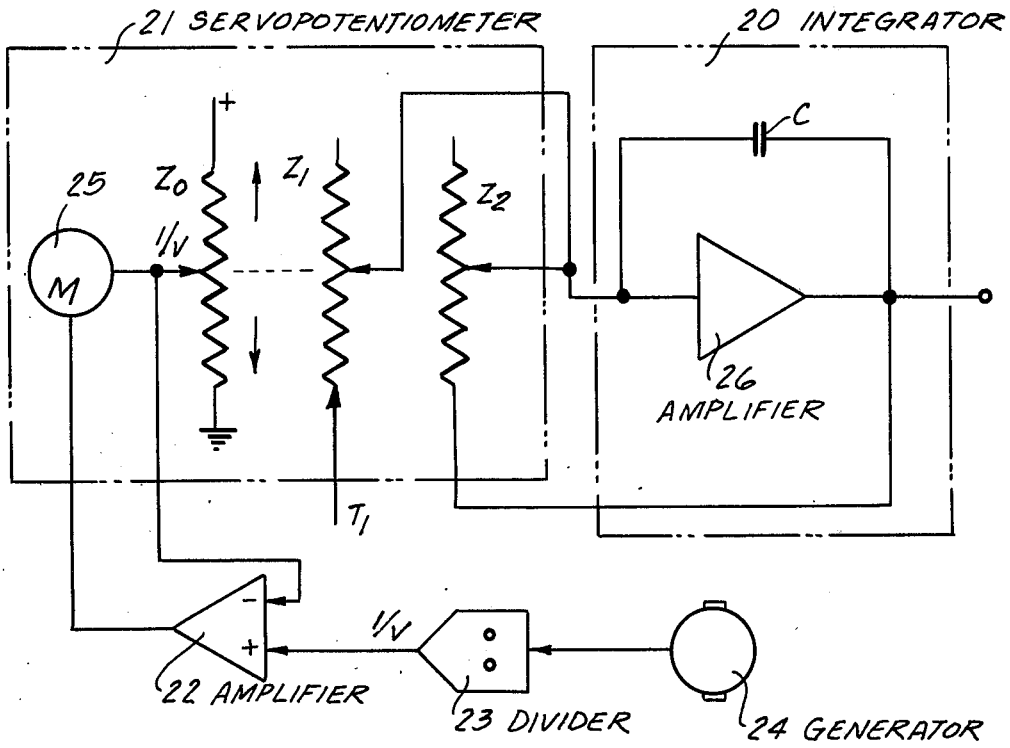
FIG. 2 shows a diagram of the correction device for measurement of the coefficient of elasticity.
Figure 3:
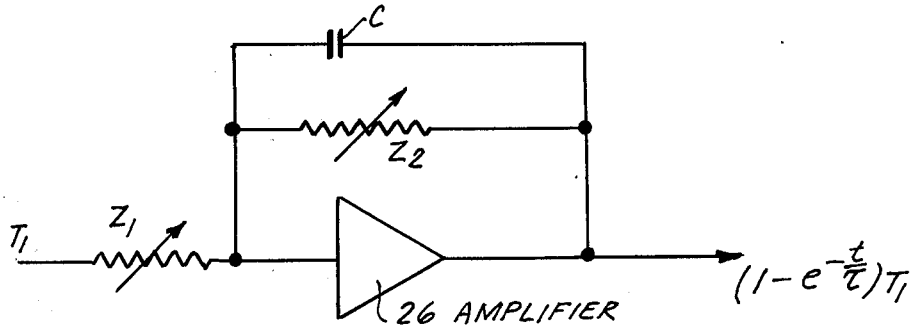
FIG. 3 shows the electrical circuit of the correction device as in FIG. 2, introducing the analogue function $1 - e^{-t/\tau}$.

The function $1 - e^{-vt/L}$ is realized by means of the arrangement shown in FIGS. 2 and 3. This arrangement is composed of an integrator 20, a precision servopotentiometer 21, an operational amplifier 22 and an electronic divider 23 which provides the reciprocal of a value proportional to the speed *v* given by a tachymetric generator 24. The various elements of the circuit are known as such and are commercially available. Circuits 22 and 23 are integrated. The servopotentiometer 21 includes a motor 25 which drives simultaneously the sliders of three variable resistors $Z_O$, $Z_1$, and $Z_2$. The variable resistor $R_o$ connected between a positive supply and earth has its slider linked to one of the inputs of the operational amplifier 22, the other input being constituted by a voltage proportional to 1/v at the output of circuit 23.

The variable resistors $Z_1$ and $Z_3$ are connected in series and in parallel respectively with the operational amplifier 26 of integrator 20, as is more clearly seen in the electrical circuit of FIG. 3. A capacitor C is connected in parallel with resistor $Z_2$. The electrical value proportional to the mechanical tension $T_1$ is supplied to the other terminal of the variable resistor $Z_1$. This circuit reproduces the function $T_1\ (1 - e^{-t/\tau})$.

Since the time constant $\tau$ is proportional to $Z_2$, and $Z_2$ varies with $1/v$, we obtain the desired function.

Figure 4:
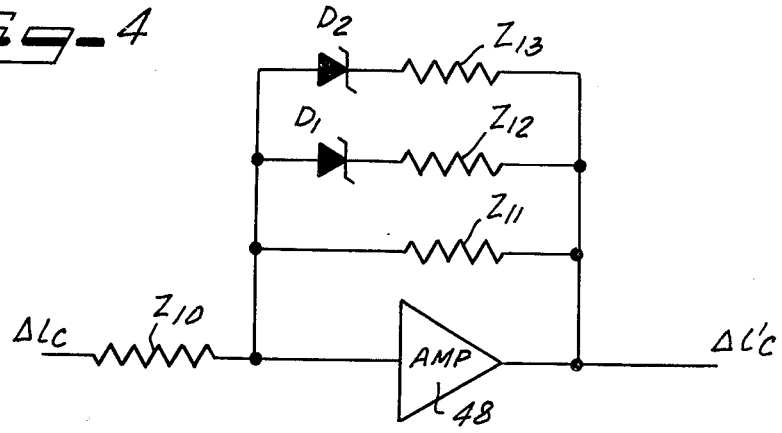
FIG. 4 shows the electrical circuit for introduction of a non-linear function into the set elongation, permitting the non-linear "tension-elongation" characteristic of certain materials to be taken into account.

FIG. 4 shows a circuit 38 reproducing the function $\Delta L'c = F(\Delta Lc)$.

This circuit is a diode function generator as is currently used in analogue calculations. It comprises an operational amplifier 48 in series with a resistor $Z_{10}$ and in parallel with three resistors $Z_{11}$, $Z_{12}$ and $Z_{13}$, the resistors $Z_{12}$ and $Z_{13}$ being themselves each in series with a zener diode $D_1$ and $D_2$ respectively. Initially only resistor $Z_{11}$ is in circuit, then when the voltage proportional to $\Delta Lc$ applied to the circuit input increases the Zener diodes $D_1$ and $D_2$ successively become conducting and the resistors $Z_{12}$ and $Z_{13}$ are successively brought into circuit, which changes the slope of $$\frac{\Delta L'_c}{\Delta L_c}$$

Figure 5:
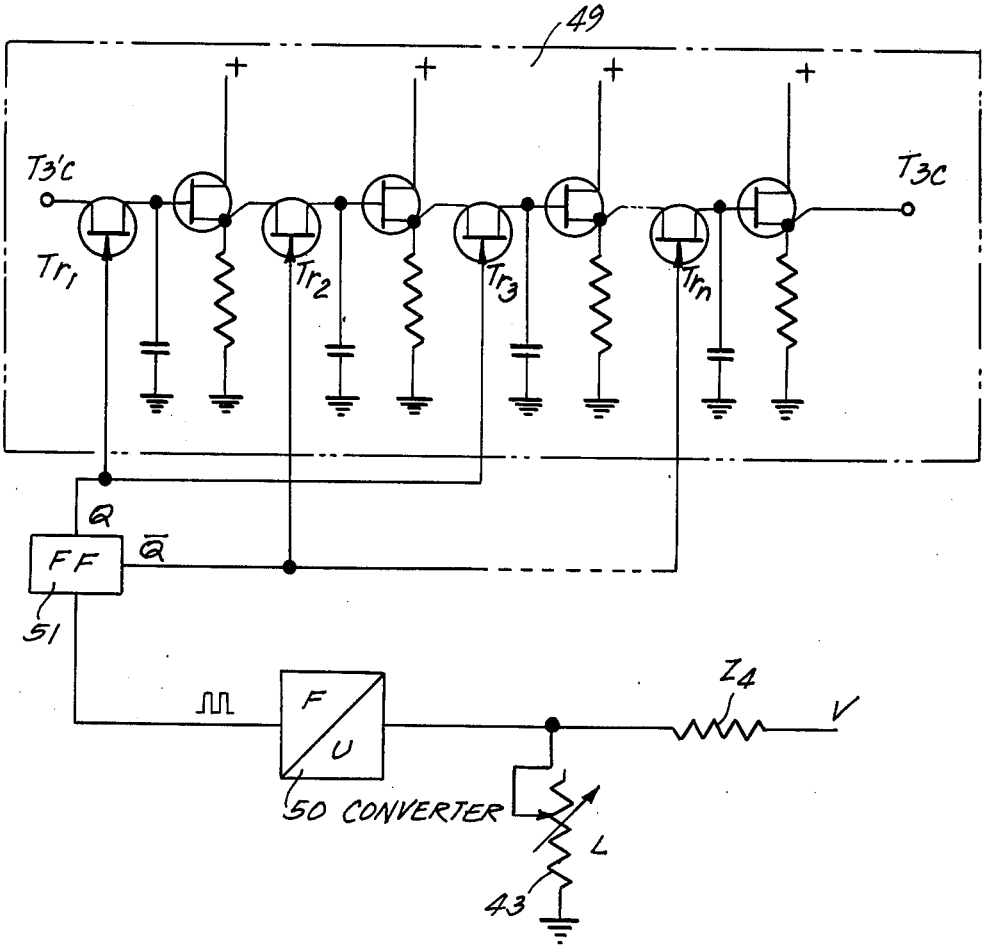
FIG. 5 shows the electrical circuit for introduction of a pure delay allowing for the displacement of the strip and the distance from the printing unit.

FIG. 5 shows circuit 42. It comprises a cascade of analogue memories 49, a circuit which is commercially available in the integrated form, a voltage-frequency converter 50, constituted by an impulse generator and a flip-flop 51 controlled by the converter 50 and with its outputs Q and Q applied to transistors $Tr_1$, $Tr_2$, etc. of the cascade of analogue memories 49 in such a manner as to transfer the information from one memory to the other at the frequency of the impulses received. This frequency is the frequency of the impulses generator 50. It must be proportional to the strip speed *v* and inversely proportional to the length L of the strip. For this purpose, the voltage proportional to the strip speed is applied to circuit 17 and is also applied to converter 50 through a resistor $Z_4$. The voltage corresponding to length L is given by the potentiometer 43 already mentioned.

The use and advantages of the equipment will be illustrated by some examples.

EXAMPLE 1

It is required to carry out an introduction at constant elongation. The engraved cylinders of the rotary have a circumference of 1000 mm and it is required to obtain a 998 mm format at zero tension, that is to say strip at rest. Such requirements exist at present when the final format is important (conventional platen, draft printing, etc.).

$(R_2 - R_1)/R_1 = 0.001$ is chosen.

Given that a 998 mm format at zero tension is sought, the elongation $\Delta Lc$ to be obtained is 2 parts in 1000. Since this elongation is desired starting from a strip at rest, the tension to be applied is 0. In this case, the tension $T_c$ is proportional to the measured coefficient of elasticity.

EXAMPLE 2

It is required to introduce the strip at constant elongation under a determined tension. This is the case, for example, for insetting of a rotary cutter.

Since the circumference of the helio cylinders is 1000 mm, that of the typographical cylinders is 997 mm and the unwinding tension on the typographic unwinder is 25 kg, the following values of the settings must be used:

$$\Delta Lc = 3 \text{ parts in } 1000$$

$$T_c = 25 \text{ kg}$$

In other words, this means that the 997 mm format must be obtained under a tension of 25 kg since the strip is subjected to that tension from the time of its introduction into the typographic machine. In this case it follows from the preceding formulae that the tension no longer varies proportionally to the coefficient of elasticity.

EXAMPLE 3

If a feed at constant tension is required according to the present method, the elongation is set to 0 and the tension is set to the required value.

In general, the length of the format is determined by the following relationships where $C$ is the circumference of the cylinder.

$$L \text{ (at rest)} = C\,(L - \Delta Lc\ Tc/K)$$

$$L \text{ (under tension)} = c\,(L - \Delta Lc)$$

I claim as my invention:

1. In an apparatus for feeding a web of material to a printing machine:

means for continually measuring the coefficient of elasticity of the web and for generating an electrical signal output in response thereto, said continually measuring means comprising means for determining an elongation of the web under given tension conditions, means for sensing said given tension conditions, calculator means for utilizing said determined elongation and said sensed tension to produce a signal which is continually indicative of the coefficient of elasticity of said web; means for utilizing said electrical signal response for developing a tension value signal; electrical-mechanical tensioning means operatively coupled to said web; and means for applying said tension value signal to said electrical-mechanical tensioning means for regulating the tension on the web in response to said coefficient of elasticity.

2. An apparatus in accordance with claim 1 wherein said calculator includes means for introducing a correction signal into said sensed tension conditions to compensate for the non-linearity of the tension elongation function of said web.

3. An apparatus in accordance with claim 2 wherein said means for sensing said given tension comprises first and second tension measuring devices for producing first and second tension signals, a first traction roller disposed between said devices and a second traction roller disposed after said devices along the path of travel of the web; and means for introducing said correction signal into the output of only one of said first and second tension measuring devices.

4. An apparatus in accordance with claim 3 wherein the outputs of said tension measuring devices as modified by said correction signal are coupled to means developing an electrical signal which is proportional to the difference between said tension measuring device outputs.

5. An apparatus in accordance with claim 3 wherein said correction signal is produced by means for modifying said one tension signal by the factor $1 - e^{-x}/L$ wherein x equals the distance traveled by the web per unit of time and $L$ equals the length of the web between said first and second traction rollers.

6. An apparatus in accordance with claim 3 wherein said means for determining said elongation comprises arranging said first and second traction rollers to have slightly different radii and circuit means for utilizing said different radii values to compute the specific elongation of the web.

7. An apparatus in accordance with claim 1 wherein at a circuit point between the point of developing said coefficient of elasticity signal and the point of utilizing said signal at said electricalmechanical tensioning means, there is provided means to develop a delay signal and to modify the tension value signal thereby, said delay signal being of such a form as to compensate for the effects of the length of said web between tension sensing point and the subsequent printing machine.

* * * * *